United States Patent [19]

Hahn

[11] Patent Number: 4,851,803

[45] Date of Patent: Jul. 25, 1989

[54] SPLIT CORE INSULATOR AND LOCKING DEVICE

[75] Inventor: Arthur Hahn, Skillman, N.J.

[73] Assignee: E-Mon Corporation, Skillman, N.J.

[21] Appl. No.: 223,604

[22] Filed: Jul. 25, 1988

[51] Int. Cl.[4] ..... H01F 17/06; H01F 27/26

[52] U.S. Cl. ..... 336/176; 174/92; 324/127; 336/210; 336/212

[58] Field of Search ..... 324/127; 174/92; 333/81 R, 1 , L18 L, 183, 243; 336/174, 233, 175, 176, 92, 229, 212, 210, 90, 198

[56] References Cited

U.S. PATENT DOCUMENTS

| | | | |
|---|---|---|---|
| 2,709,800 | 5/1955 | Temple et al. . | |
| 3,219,930 | 11/1965 | Sipler | 324/127 X |
| 3,314,009 | 4/1967 | Murdock | 324/127 X |
| 3,323,056 | 5/1967 | Haley | 324/127 X |
| 3,374,434 | 3/1968 | Penny | 324/127 |
| 3,883,835 | 5/1975 | Pagon et al. | 336/176 |
| 4,048,605 | 9/1977 | McColium | 336/176 |
| 4,049,357 | 9/1977 | Hamisch, Jr. | 174/92 X |
| 4,234,863 | 11/1980 | Shumway et al. | 336/90 |
| 4,258,348 | 3/1981 | Belfer et al. | 336/176 X |
| 4,286,213 | 8/1981 | Fowler | 324/127 |
| 4,408,175 | 10/1983 | Nelson et al. | 336/92 |
| 4,426,108 | 1/1984 | Kesselman | 174/92 X |
| 4,471,300 | 9/1984 | Harnden, Jr. et al. | 324/127 |
| 4,558,276 | 12/1985 | Comeau et al. | 324/127 X |
| 4,728,919 | 3/1988 | Dirmeyer | 336/229 X |

FOREIGN PATENT DOCUMENTS

| | | | |
|---|---|---|---|
| 624455 | 1/1936 | Fed. Rep. of Germany | 336/176 |
| 11729 | 9/1956 | Fed. Rep. of Germany | 336/176 |
| 129316 | 10/1979 | Japan | 336/176 |

*Primary Examiner*—Thomas J. Kozma
*Attorney, Agent, or Firm*—Richard C. Woodbridge

[57] ABSTRACT

A pair of identical covers house and insulate two split cores of the type used to submonitor current flow into a breaker box. The covers keep the cores in correct alignment and identify the proper orientation of a pick-up transformer that is coupled to the cores. The covers are molded from a non-conducting plastic and have an integral locking mechanism utilizing a living hinge. Integral spring tabs and integral alignment tabs hold the split cores securely next to one another. Arrow markings on the split covers are matched with an arrow marking on the pick-up transformer which is placed around the assembled covers to form a current sensing unit. The face of the current sensing unit with the arrows is directed towards the current source. Electric current can then be monitored using a digital watt/hour meter connected to the current sensing unit. The locking mechanism of the covers enables the current sensing unit to be easily removable for use at other locations.

12 Claims, 6 Drawing Sheets

28
40
42
32a
50
46
W
41
A
58
60
L
43
62
44
54
52
20°
56
74
48
70
72
64
68
69
65
67
66

SPLIT CORE INSULATOR AND LOCKING DEVICE

BACKGROUND OF THE INVENTION

1. Field of the Invention

The invention relates to a split core insulating cover and locking apparatus for holding two split cores in position around a conductor whose current load is to be determined.

2. Description of Related Art

Submetering of electricity provides the opportunity to conserve energy consumption by monitoring individual circuits. Submetering also has economic advantages such as branch circuit metering for two or more tenants or loads on the same subpanel. However, practical utilization of submetering requires monitoring equipment that does not require interconnection or severing of the circuits to be measured. Use of a ferrous core with a pick-up transformer to encircle a conductor and measure current flow is well known in the art. Current flowing through the conductor generates a magnetic flux in the encircling core. A pick-up transformer encircles or is wound onto the core. The windings of the pick-up transformer must correspond to the direction of current flow in the measured conductor. The flux in the core generates a voltage in the pick-up transformer that is representative of the current flow in the measured conductor.

One present method of fastening the split cores to the conductor is to place the cores around the conductor with the pick-up transformer attached directly around the cores. The split cores are then strapped together using common plastic ties such as made by the Panduit Corporation. The split cores are not insulated from the surrounding electrical components. The proper orientation of the pick-up transformer must be obtained by correctly determining current flow and the direction of the generated magnetic flux relative to he windings in the pick-up transformer.

U.S. Pat. No. 4,286,213 describes a one piece U-shaped bracket which functions as a core. A pin fastens a pick-up transformer between the legs of the bracket thus encircling the conductor to be monitored. The bracket is not insulated on its outside surface. Further, the core does not completely surround the conductor.

A four-part laminated core with the pick-up transformer integrally wound onto one or more parts of the core is described in U.S. Pat. No. 3,883,835. Four corner brackets and four tubes are used to surround the core and hold it together. Bolts or similar fasteners are used to assemble the four parts of the core cover together. Various current load ranges must be matched to appropriately sized pick-up transformers. A core assembly with an integrally wound pick-up transformer can be used for only one current load range.

U.S. Pat. No. 4,408,175 discloses a two-part hinged plastic housing for enclosing a pick-up transformer. The device is designed to fasten a pick-up transformer directly to the conductor without the use of a ferromagnetic core. Non-magnetic stainless screws are used to lock the two halves of the housing around the conductor.

U.S. Pat. Nos. 4,471,300; 4,258,348; 4,048,605; 3,314,009; 2,709,800 disclose typical hinged split-core encircling devices with pick-up transformers. None of the disclosures provide a means for covering the core and locking the core and its pick-up transformer onto the conductor.

U.S. Pat. Nos. 4,234,863 and 4,558,271 are of general interest only to the invention.

An insulating cover for a split core, capable of locking the core and its pick-up transformer around the conductor without screws, bolts or tie straps does not appear to be found in the prior art. A simple two piece cover, inexpensive to manufacture, and capable of being easily fastened and removed is not shown. Means for insuring proper orientation of a pick-up transformer relative to the current flow in the monitored conductor is not disclosed.

DETAILED DESCRIPTION OF THE INVENTION

During the course of this description like numbers will be used to identify like elements according to the different views that illustrate the invention.

Figure 1:
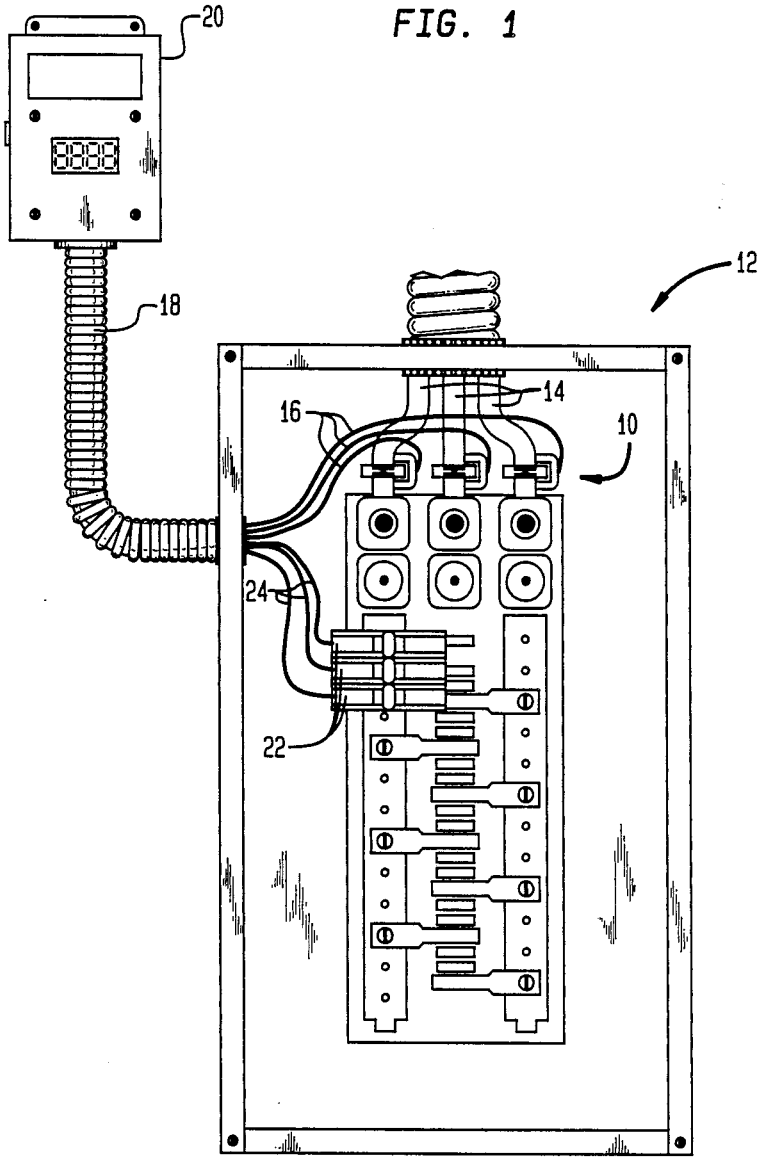
FIG. 1 illustrates the preferred embodiment of the split core insulating cover and locking apparatus invention shown in the context of a conventional breaker panel.

FIG. 1 illustrates the preferred embodiment of invention 10 in the context of a conventional breaker panel. Invention 10 encircles each lead 14 of a three phase lead-in cable. Leads 16 connect invention 10 to watt/-hour meter 20 via armored cable 18. Watt/hour meter 20 obtains voltage information corresponding to lead-in wires 14 by connecting to voltage pick-up connections 22 via voltage pick-up leads 24.

Figure 2:
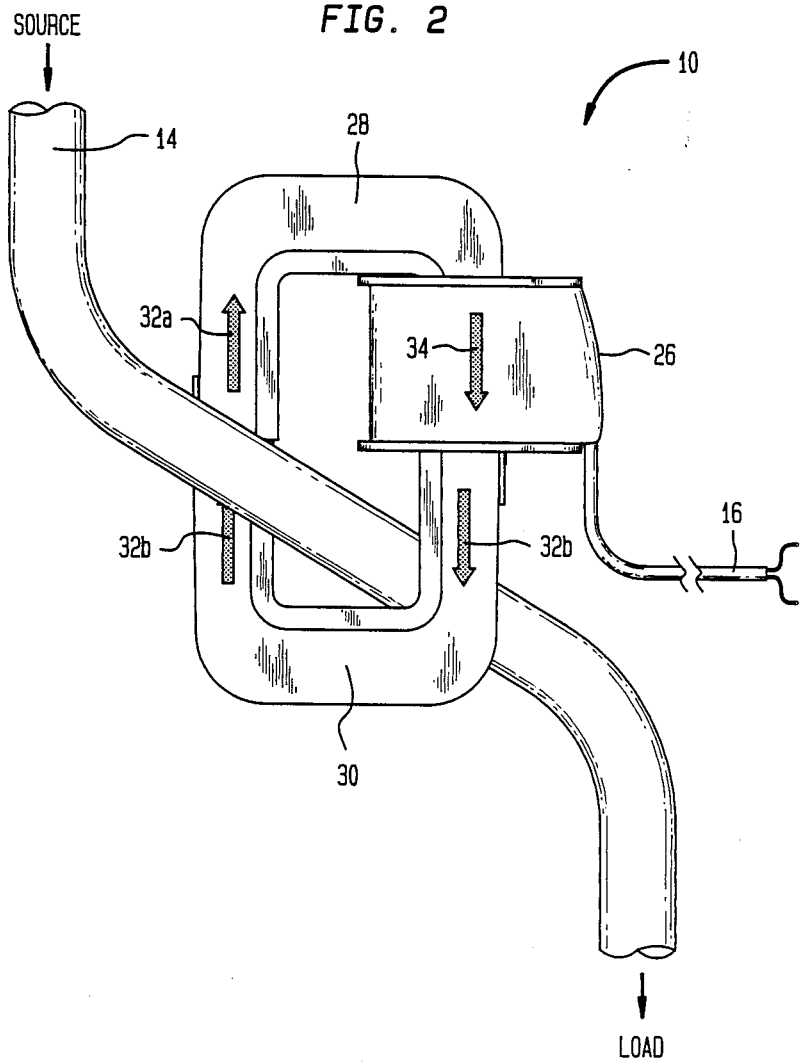
FIG. 2 illustrates the assembled invention in the context of a single lead-in wire.

FIG. 2 illustrates the preferred embodiment of invention 10 in the context of a single lead-in wire 14. First cover 28 containing first split core 36 is fastened to second cover 30 containing split core 38. First cover 28 and second cover 30 can only be fastened such that upper arrows 32*a* and lower arrows 32*b* align in a clockwise manner. Pick-up transformer 26 surrounds one leg of the covers such that arrow 34 of pick-up transformer 26 is aligned in the same direction as arrows 32*a* and 32*b* on the respective covers. Leads 16 connect pick-up transformer 26 to watt/hour meter 20. The locked covers 28 and 30, containing the split cores 36 and 38, and attached pick-up transformer 26 enables the current flowing in line 14 to be measured. The invention 10 is securely fastened to line 14 without the use of screws, bolts, straps or other non-integral fasteners. Arrows 32*a*, 32*b*, 34 align in a clockwise direction facing the source of the current in lead 14. The windings in pick-up transformer 26 are then correctly oriented to measure the current in lead 14.

Figure 3:
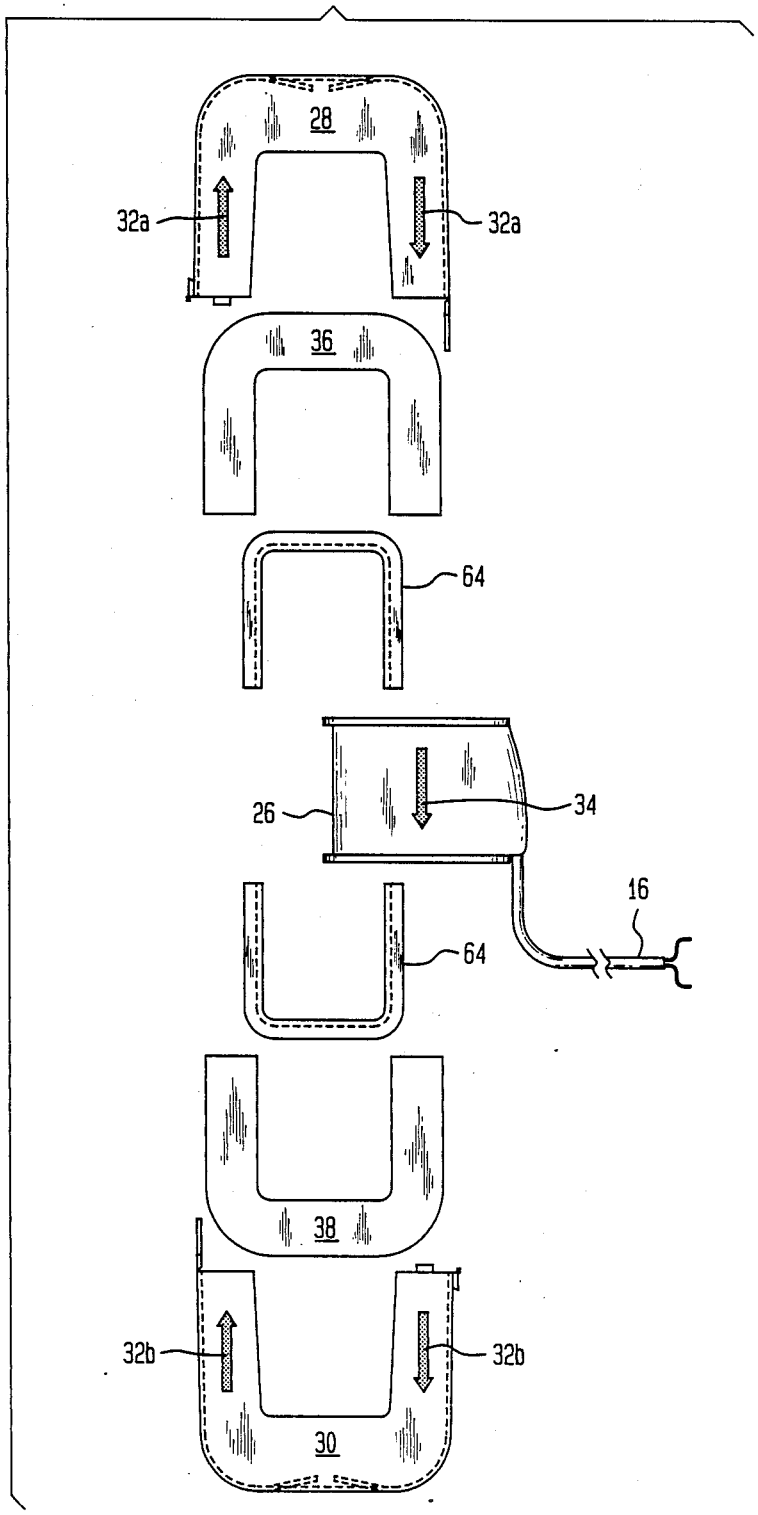
FIG. 3 is an exploded view of the split core insulating cover and locking apparatus illustrated in FIG. 2.

FIG. 3 shows an exploded view of the split core insulating cover and locking apparatus illustrated in FIG. 2. First cover 28 in the preferred embodiment is essentially identical to second cover 30. Preferably the covers are fabricated out of a co-polymer polypropylene but other plastics such as nylon could also be used. First split core 36 in the preferred embodiment is essentially identical to second split core 38. Pick-up transformer 26 is coupled to covers 28 and 30 so that its arrow 34 is aligned with arrows 32*a* on first cover 28 and arrows 32*b* on second cover 30. Inserts 64 are an alternative embodiment and used to insulate the inner surface of the split cores. Inserts 64 will be explained more fully in FIGS. 4*f* and 4*g*.

Figures 4A, 4B, 4C, 4F, 4G:
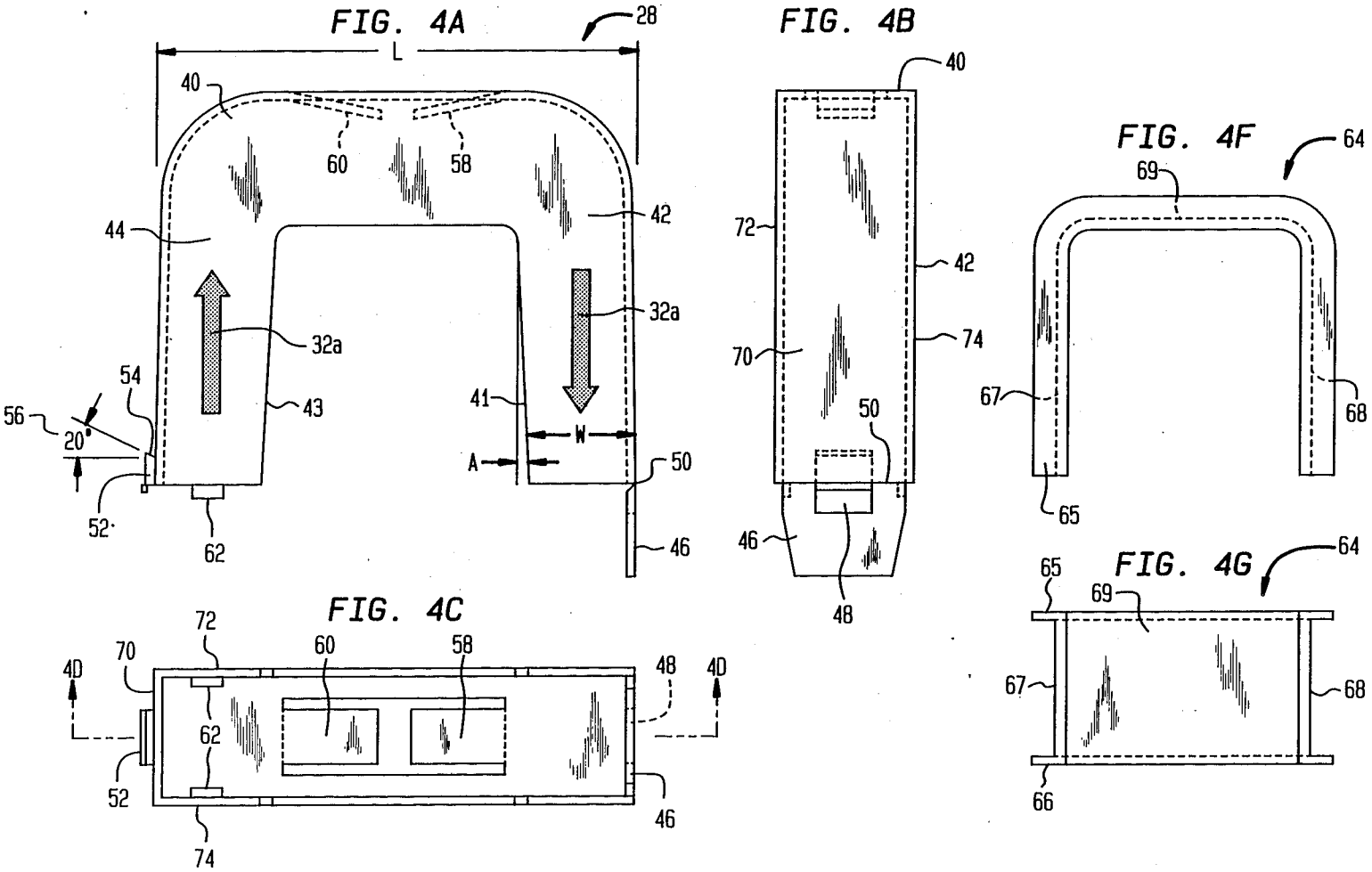
FIG. 4*a*, is a front elevational view of one of the two split core insulating covers.
FIG. 4*b* is a right side elevational view of the split core insulating cover illustrated in FIG. 4*a*.
FIG. 4*c* is a bottom plan view of the split core insulating cover of FIG. 4*a*.
FIG. 4*f* illustrates a front elevation view of an insulating insert to insulate the inside of the split core assembly.
FIG. 4*g* is a bottom plan view of the insulating insert.

FIG. 4*a* is a front elevational view of first cover 28. Arrows 32*a* are preferably slightly raised from the surface of first section 42 and second section 44 of cover 28. However, arrows 32*a* could also be embossed or stamped on the respective sections of cover 28. Arrow 32*a* on first section 42 points away from center section 40 while arrow 32*a* on second section 44 points toward center section 40. The size of arrows 32*a* is not critical but should be large enough to be easily discernible by a user.

First spring tab 58 and second spring tab 60 of center section 40 urge split core 36 against split core 38 when first cover 28 is fastened to second cover 30. In the preferred embodiment, spring tabs 58 and 60 are approximately the same size and integral with center section 40. While the size of spring tabs 58 and 60 is not critical, the length must be sufficient to insure that the cores are held firmly together. Spring tabs 58 and 60 approximately one half inch in length are preferred.

Alignment tabs 62 on second section 44 align first cover 28 with the second cover 30. Living hinge 50 connects locking tab 46 to first section 42. The locking lug 52 is attached to second section 44. Locking lug 52 has an aperture engaging projection ledge 54. Ledge 54 is set at angle 56 relative to the axis L of section 40. Angle 56 of projection ledge 54 allows locking tab 46 to be held firmly in place when first cover 28 and second cover 30 are locked together. Angle 56 must also permit locking tab 46 to be unlocked when the current sensing assembly is moved to a new location. Angle 56 may range from 10 degrees to 30 degrees with the preferred angle being 20 degrees.

The width W of first section 42 is slightly tapered from center section 40 along inner edge 41. Similarly, the width W of second section 44 is slightly tapered from center section 40 along inner edge 43. The purpose of the taper is to permit the covers to be easily released from the mold. This amount of taper is not critical with 3 degrees being preferable.

FIG. 4*b* is the right side elevational view of the first cover 28 showing first section 42 attached to center section 40. First section 42 is U-shaped. It is formed by front outside wall 72 and back outside wall 74 connected to opposite edges of center wall 70, thus forming an inner open side 71, shown in FIG. 4*c*, opposite to center wall 70. Sections 40 and 44 are similarly constructed thus forming a U-shaped channel in which first split core 36 can be inserted. The inside dimensions of sidewalls 72 and 74 and center wall 70 correspond simultaneously to the outside dimensions of the split core that is to be inserted.

FIG. 4*c* is a bottom plan view of first cover 28. Locking tab 46 is attached to the bottom of first section 42 via living hinge 50. Locking tab aperture 48 is provided in locking tab 46. Locking tab aperture 48 is sized to snap over locking lug 52. Alignment tab 62 is attached to the inside surface of second section 44 and is designed to fit within the inside surface of the first section of second cover 30, i.e. the section of second cover 30 having a locking tab. The U-shaped channel which receives one of the split cores is formed by front outside wall 72 and back outside wall 74 connected to opposite edges of center outside wall 70. Spring tab 58 and spring tab 60 are shown in the preferred embodiment of being integral with center section 40.

Figure 4D:
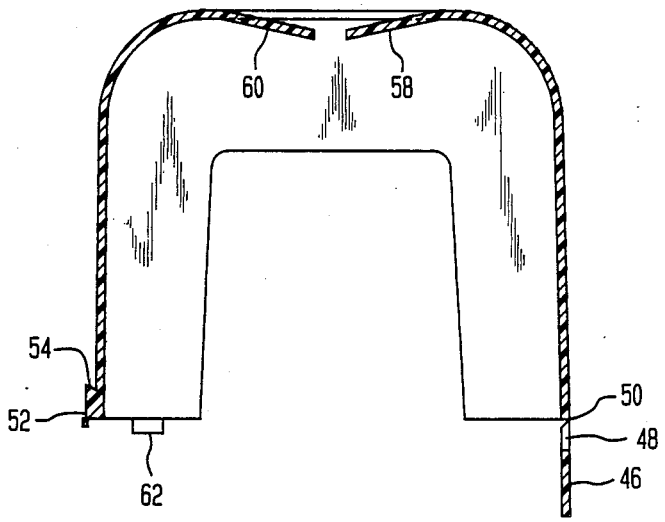
FIG. 4*d* is a cross-sectional view of the split core insulating cover illustrated in FIG. 4*c*.

FIG. 4*d* illustrates a cross section through FIG. 4*c*. Spring tabs 58 and 60 extend downward away from section 40. When split core 36 is inserted in cover 28, spring tabs 58 and 60 cause split core 36 and split core 38 in cover 30 with its corresponding spring tabs, to urge the two cores against one another. Alignment tab 62 of cover 28 and the corresponding alignment tab in cover 30 insure that the split cores are properly aligned.

Figure 4E:
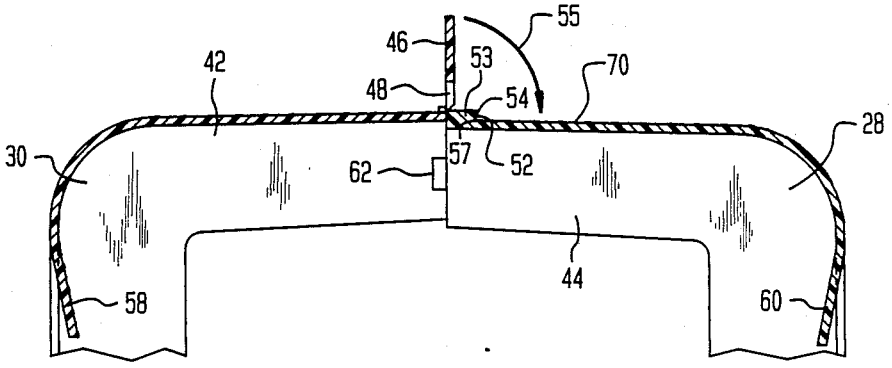
FIG. 4*e* is a detailed view illustrating the manner in which the locking tab of a first split core insulating cover engages the locking lug of a second split core insulating cover.

FIG. 4*e* illustrates the locking tab of second cover 30 engaging locking lug 52 of first cover 28. As locking tab 46 of first cover 28 is essentially identical to the locking tab of second cover 30; first section 42 of first cover 28 is essentially identical to the first section of second cover 30, accordingly, the numbers used to identify elements in first cover 28 are used to identify essentially identical elements in second cover 30. Locking tab 46 is connected to first section 42 by living hinge 50. Locking tab 46 is pivoted along arc 55. Locking tab aperture 48 engages locking lug 52 by stretching over the widest point 53 of locking lug 52 and resting against the narrowest point 57 of locking lug 52. The resiliency of the plastic in combination with the force provided by spring tabs 58 and 60 in covers 28 and 30 keep locking tab 46 engaged with locking lug 52. Locking tab 46 rests against center wall 70 of second section 44.

FIGS. 4*f* and 4*g* illustrate an alternative embodiment of invention 10 requiring the use of insert 64. Insert 64 insulates split core 36 by covering inner open side 71 for those situations where complete insulation of the split cores is required. Flange 65 is a U-shaped member perpendicularly attached to wall 67. On the opposing edge of wall 67 is another flange 66. Flanges 65 and 67 snap over the front and rear surfaces of section 44. Correspondingly, wall 68, opposite to wall 67 is connected by wall 69, thus forming a U-shaped insert. Flange 65 extends around walls 68 and 69, similarly perpendicularly attached. Flange 66 is attached to the opposite edges of the aforementioned walls, thus forming a channel that can be snapped onto cover 28 to close off the open end of cover 28 after split core 36 is inserted. An essentially identical insert 64 would be used for cover 30.

Figure 5:
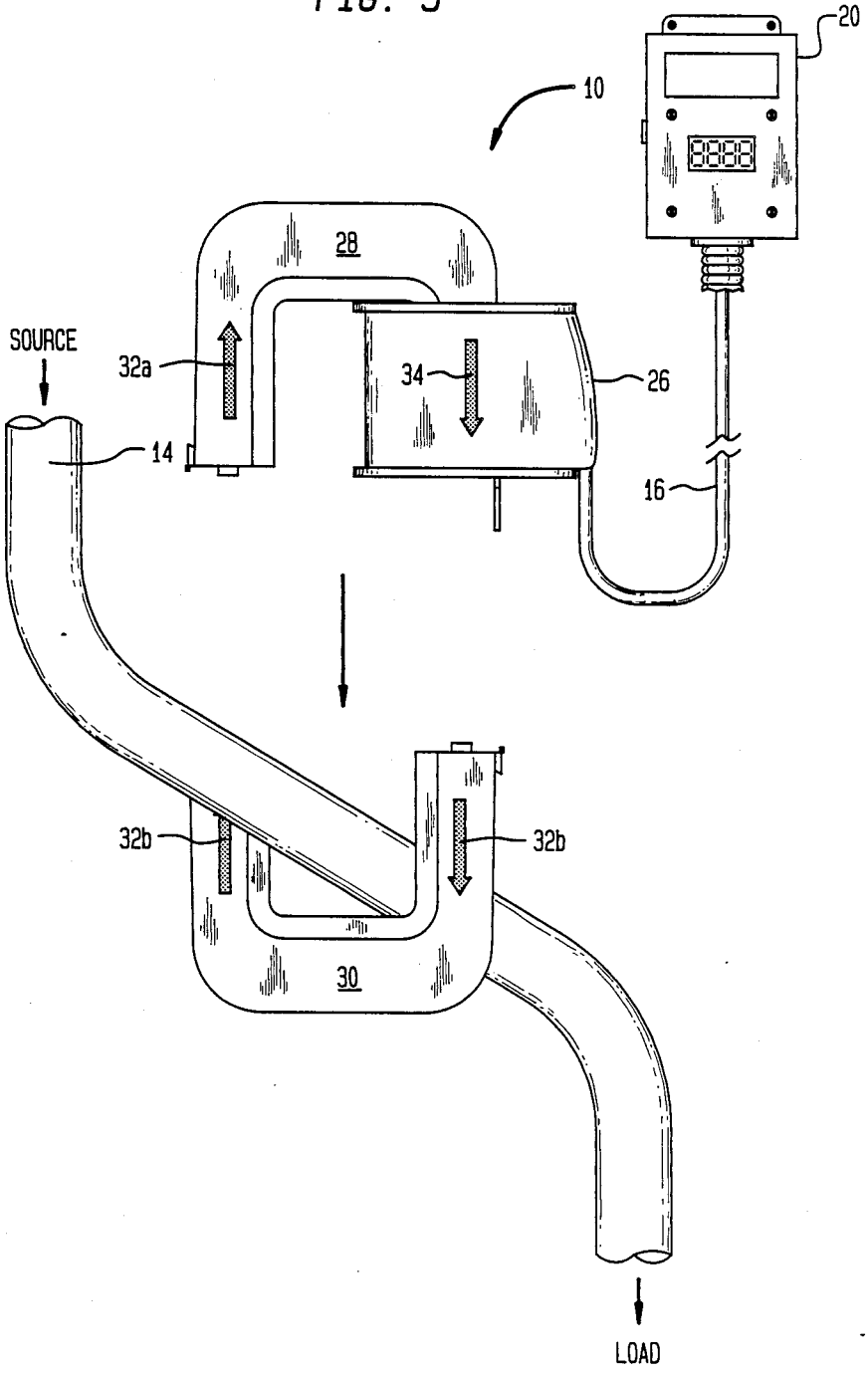
FIG. 5 illustrates the assembly step of placing the split cores, split core covers, and pick-up transformer around a single incoming lead and connecting the assembly to a conventional watt/hour meter.

FIG. 5 shows the assembly of placing invention 10 around line 14. Split cores 36 and 38 are inserted in their respective cover 28 and 30. If inserts 64 are to be used then inserts 64 would then be snapped onto covers 28 and 30. Pick-up transformer 26 is then slid onto the section of invention 10 so that arrow 34 of pick-up transformer 26 matches the direction of arrows 32*a* and 32*b* on the covers. Covers 28 and 30 with pick-up transformer 26 are placed around line 14 which is the line that is to be measured. First one locking tab is snapped, then the other, thus locking the entire assembly firmly on the line 14. Leads 16 are then connected to a conventional watt/hour meter 20 to complete the installation.

The invention 10 just described has several distinct advantages over the prior art devices. First, it couples a pick-up transformer and split cores to an electrical conductor conveniently without using bolts, screws or other fasteners. Second, it insures that windings of the pick-up transformer will always be aligned properly relative to the current flow in the conductor. Third, the split cores are insulated by the non-conducting covers. Fourth, different current range pick-up transformers can be used with the same sized split cores. Fifth, the covers can be easily disassembled and moved to different locations. Sixth, as the two halves of the covers are essentially identical and as all the components are integral with the cover, the apparatus consists of a single easily manufactured part. It can easily be made in a two part mold thus producing both essentially identical halves simultaneously.

While the invention has been described with reference to a preferred embodiment thereof, it will be appreciated by those of ordinary skill in the art that modifications can be made to the parts that comprise the invention without departing from the spirit and scope thereof.

I claim:

1. A split core insulating cover and locking apparatus for covering at least a first and a second split core of the type that is couplable to a pick-up transformer attachable to a watt/hour meter, said apparatus comprising:

a first cover for encasing at east a portion of said first split core, said first cover having a generally U-shaped configuration and including a center section having a long axis and a first side section and a second side section perpendicular to said long axis and attached to opposite sides of said center section, said first cover also having a generally U-shaped cross section which forms a channel for receiving said first split core, said U-shaped channel defined by a central wall and a pair of sidewalls attached on opposite sides of said central wall thereby providing an inner open side between said sidewalls;

a second cover for encasing at least a portion of said second split core, said second cover having a generally U-shaped configuration and including a center section having a long axis and a first side section and a second side section perpendicular to said long axis and attached to opposite sides of said center section, said second cover also having a generally U-shaped cross section which forms a channel for receiving said first split core, said U-shaped channel defined by a central wall and a pair of sidewalls attached on opposite sides to said central wall thereby providing an inner open side between said sidewalls; and, locking means for connecting said first and second covers to each other, said locking means comprising at least a tab attached by a flexible, pivotable hinge to said first side section of said first and second covers, said tab including an aperture having an engaging edge therein, and, a projection attached to an outer wall of said second side section of said first and second covers and selectively engageable in said aperture in said tab, wherein said first and second covers may be selectively locked and disengaged with respect to each other.

2. The apparatus of claim 1 wherein said projection includes a ledge surface thereon that is angled with respect to said long axis of said center section such that when said aperture is stretched over said projection, said ledge surface is firmly urged against said engaging edge locking said tab and said projection together with said tab coming to rest against the outerwall of said center section.

3. The apparatus of claim 2 wherein the angle of said ledge surface is between 10 and 30 degrees.

4. The apparatus of claim 3 further comprising:

spring means integral with the central sections of said first and second cover for urging said first and second cores towards each other when said first and second covers are locked together.

5. The apparatus of claim 4 wherein said spring means comprise at least two tabs integrally molded into said central section of said first and second covers.

6. The apparatus of claim 5 further comprising:

an aligning guide integrally attached to at least one of said first and second sections for extending beyond said first and second sections and aligning said first and second covers when they are brought into locking engagement with each other.

7. The apparatus of claim 6 wherein said pick-up transformer includes alignment indicia thereon, said apparatus further comprising:

alignment indicia located on said first and second covers for properly aligning said pick-up transformer with said first and second split cores when said first and second split cores are connected together or locked together by said first and second covers.

8. The apparatus of claim 7 wherein said first and second covers are substantially identical in shape and structure.

9. The apparatus of claim 8 wherein said first and second covers are formed from a plastic material having high electrical insulative properties.

10. The apparatus of claim 9 wherein said first and second covers are formed from co-polymer polypropylene.

11. The apparatus of claim 10 further comprising:

insert means for covering the open surface of said U-shaped channel and attached to said sidewalls thereby completely encasing said first and second cores when locked in position by said first and second covers.

12. A split core insulating cover and locking apparatus for covering at least a first and a second split core of the type that is couplable to a pick-up transformer attachable to a watt/hour meter, said apparatus comprising:

a first cover for encasing at least a portion of said first split core, said first cover having a generally U-shaped configuration and including a center section having a long axis and a first side section and a second side section perpendicular to said long axis and attached to opposite sides of said center section, said first cover also having a generally U-shaped cross section which forms a channel for receiving said first split core, said U-shaped channel defined by a central wall and a pair of sidewalls attached on opposite sides of said central wall thereby providing an inner open side between said sidewalls;

a second cover for encasing at least a portion of said second split core, said second cover having a generally U-shaped configuration and including a center section having a long axis and a first side section and a second side section perpendicular to said long axis and attached to opposite sides of said center section, said second cover also having a generally U-shaped cross section which forms a channel for receiving said second split core, said U-shaped channel defined by a central wall and a pair of sidewalls attached on opposite sides to said central wall thereby providing an inner open side between said sidewalls;

locking means for connecting said first and second covers to each other, said locking means comprising at least a tab attached by a flexible, pivotable hinge to said first side section of said first and second covers, said tab including an aperture having an engaging edge therein, and, a projection attached to an outer wall of said second side section of said first and second covers and selectively engageable in said aperture in said tab;

spring means integral with the center sections of said first and second covers for urging said first and second cores towards each other when said first and second covers are locked together, said spring means comprising at least two tabs integrally molded into said center section of said first and second covers; and, alignment indicia located on said first and second covers for properly aligning said pick-up transformer with said first and second split cores when said first and second split cores are connected together by said first and second covers, wherein said first and second covers may be selectively locked and disengaged with respect to each other, and wherein said pick-up transformer includes alignment indicia thereon for alignment with the alignment indicia on said first and second covers so that said pick-up transformer properly senses the current induced in said first and second cores.

* * * * *